US007191904B2

(12) United States Patent
Wescott, III

(10) Patent No.: US 7,191,904 B2
(45) **Date of Patent: *Mar. 20, 2007**

(54) 8GC PLATFORM

(76) Inventor: Harvey M. Wescott, III, 37 Bart Rd., North Billerica, MA (US) 01862

( * ) Notice: Subject to any disclaimer, the term of this patent is extended or adjusted under 35 U.S.C. 154(b) by 303 days.

This patent is subject to a terminal disclaimer.

(21) Appl. No.: 10/785,613

(22) Filed: Feb. 24, 2004

(65) Prior Publication Data

US 2005/0161414 A1 Jul. 28, 2005

Related U.S. Application Data

(63) Continuation of application No. 29/198,215, filed on Jan. 27, 2004, now Pat. No. Des. 507,658.

(51) Int. Cl.
*A47B 73/00* (2006.01)

(52) U.S. Cl. ..... 211/74; 211/85.18; 206/563

(58) Field of Classification Search ..... 211/74, 211/85.18, 85.13; 422/101, 104; 206/528, 206/438, 563, 558, 564, 363
See application file for complete search history.

(56) References Cited

U.S. PATENT DOCUMENTS 2,738,872 A * 3/1956 De Boton ..... 206/456
2,790,547 A * 4/1957 Sutton ..... 206/571
2,880,865 A * 4/1959 Knox ..... 206/456
3,379,315 A * 4/1968 Broadwin ..... 211/72
3,532,221 A * 10/1970 Kaluhiokalani et al. ... 211/70.6
3,604,566 A * 9/1971 Rem et al. ..... 211/74
3,778,232 A * 12/1973 McMorrow, Jr. ..... 422/65
4,040,234 A * 8/1977 Stockdale et al. ..... 53/471
4,124,122 A * 11/1978 Emmitt ..... 211/74
4,284,603 A * 8/1981 Korom ..... 422/101
4,407,958 A * 10/1983 DeGraff, Jr. ..... 435/283.1
4,453,639 A * 6/1984 Sharma ..... 211/74
4,495,150 A * 1/1985 Cook et al. ..... 422/99
4,588,095 A * 5/1986 Mehra ..... 211/74
5,080,232 A * 1/1992 Leoncavallo et al. ..... 206/446
5,133,939 A * 7/1992 Mahe ..... 422/104
5,169,603 A * 12/1992 Landsberger ..... 422/104
5,817,177 A * 10/1998 Wallace ..... 118/69
5,996,818 A * 12/1999 Boje et al. ..... 211/74
6,309,608 B1 * 10/2001 Zhou et al. ..... 422/131
6,568,544 B1 * 5/2003 Lafond et al. ..... 211/74

* cited by examiner

*Primary Examiner*—Jennifer E. Novosad
(74) *Attorney, Agent, or Firm*—John H. Pearson, Jr., Esq.; Walter F. Dawson, Esq.; Pearson and Pearson LLP

(57) ABSTRACT

A platform comprising a plurality of holes and slots for holding blood specimens, test tubes and gel-cards in an organized arrangement to simplify testing of the blood specimens and to eliminate the likelihood of human error. The platform comprises a top plate, a middle plate and a bottom plate which are spaced apart. The top plate and the middle plate each comprise rows of holes in a matrix configuration and a column of slots adjacent to the rows of holes. The bottom plate only has 5 screw holes for securing the top plate, middle plate and bottom plate together. A first row comprises a 16 mm hole followed by nine 12.5 mm holes equally spaced adjacent to each other and a slot (2 mm×72 mm) positioned adjacent to the last 12.5 mm hole. The testing platform comprises a total of eight rows, each row being parallel to said first row.

5 Claims, 5 Drawing Sheets

8GC PLATFORM

CROSS-REFERENCE TO RELATED APPLICATIONS

This is a continuation of Design Application No. 29/198,215, filed Jan. 27, 2004, now D,507,658.

BACKGROUND OF THE INVENTION

1. Field of the Invention

This invention relates generally to work stations for use by laboratory technicians to perform tests on specimens of blood, and in particular to testing platforms having prearranged holes and slots for receiving various size specimen tubes, test tubes, reagent bottles and/or gel-cards in an organized manner on a test platform.

2. Description of Related Art

The introduction of new Gel-Technology in a blood bank laboratory made the standard workstations obsolete because the laboratory technologist could not handle both traditional test tubes and the new Gel-Technology on one workstation. A gel-card is a device which comprises six microtubes on one card having a bottom portion that is thin and extends the width of the gel-card which is typically 2¾ inches wide and 2¹⁄₁₆ inches high. Instead the laboratory technologist was forced to use equipment which was not suited for the new gel-card technology and had to divide testing into sections or use multiple pieces of equipment which cluttered the work space making it cramped, confusing and error prone. Various errors were reported in determining a patient's blood type such as a confirming test not coinciding with an original test, specimens were misplanted, and test tubes which were previously next to each other were now separated in different areas. In particular, antibody screens, which had previously been done in test tubes next to the patient specimens, were now performed using the new gel-technology in a different location of the work space away from the specimens making it more difficult to match patients with the associated gel-cards. This problem caused errors in placing the wrong specimen in the gel-card or mismatching the patient with the gel-card, and mismatching antibodies with the patient.

A workstation platform, or rack was needed which received traditional specimen tubes, test tubes, and new gel-cards and in other platforms the capability of receiving reagent bottles. Otherwise, the laboratory technologist was required to set-up patient specimens and their tests in different locations or different times, and it was time consuming and confusing for the technologist to remember what test had been completed and on what patient specimens. More equipment was needed in the work area to perform testing, causing the work area to become smaller, cluttered and confusing.

The following U.S. patents disclose various trays in the prior art for receiving test tubes and containers:

U.S. Pat. No. 2,790,547, issued Apr. 30, 1957 to Dorothy Jean Sutton, discloses a laboratory tray for use by laboratory medical technicians in medical diagnosis. The tray comprises several sections of different depths for stacking slides, for receiving hypodermic syringes, and syringe needles, for receiving clean pipettes or for miscellaneous supplies, and the tray comprises a panel having a plurality of apertures of varying dimensions to receive larger test tubes, smaller test tubes, jars for holding dry sponges or absorbent cotton, and solution bottles. However, this tray does not have slots for receiving gel-cards for testing purposes.

U.S. Pat. No. 2,880,865, issued Apr. 7, 1959 to David C. Knox, discloses a hematologist tray comprising an outer tray and an inner tray. The outer tray comprises a plurality of various apertures for receiving restriction tubes and holes to support bottles, beakers, etc. An inner tray comprises ten pairs of openings for receiving test tubes and adjacent to each pair of openings is a slot to receive a pair of slides. However, this tray does not have the capability of handling gel-cards.

U.S. Pat. No. 3,604,526, issued Sep. 14, 1971 to Douglas J. Rem, discloses a test tube holder comprising a plurality of apertures for portability and segregation of test tubes and protection of their contents. The holder comprises a U-shaped channeled base member and a C-shaped tube-retaining support member. The C-shaped member comprises a plurality of annular, axially aligned apertures wherein upper apertures are formed perpendicular to a top wall while lower apertures are formed perpendicularly of the bottom wall 28. Other embodiments show apertures only in the top wall and do not extend into the bottom wall for conveniently handling other devices of less height. However, again there is no capability of receiving gel-cards.

SUMMARY OF THE INVENTION

Accordingly, it is therefore an object of this invention to provide an efficiently organized arrangement of holes and slots for receiving patient specimen tubes, test tubes, and gel-cards in a prearranged row order to provide a blood bank testing platform.

It is another object of this invention to provide a blood bank testing platform for laboratory technologists to perform blood testing operations in a manner that eliminates the likelihood of human errors.

These and other objects are accomplished by a blood bank testing platform comprising a top plate spaced above a middle plate and the middle plate spaced above a bottom plate, each of the top plate and the middle plate comprises a matrix of holes, the matrix of holes in the top plate being aligned with the matrix of holes in the middle plate, a column of slots in the top plate positioned adjacent to the matrix of holes in the top plate, and a column of slots in the middle plate positioned adjacent to the matrix of holes in the middle plate and directly under the column of slots in the top plate. The platform comprises a plurality of rows, each row comprises a first type hole of the matrix of holes, a plurality of a second type hole of the matrix of holes, and a slot. The column of slots in the top plate comprises a through-slot. The column of slots in the middle plate comprises a non-through slot. The platform comprises corner screws for securing the top plate, the middle plate and the bottom plate together, the screws being inserted in spacers between the top plate and the middle plate and spacers between the middle plate and the bottom plate. The corner screws are screwed into standoffs on the bottom of the bottom plate.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
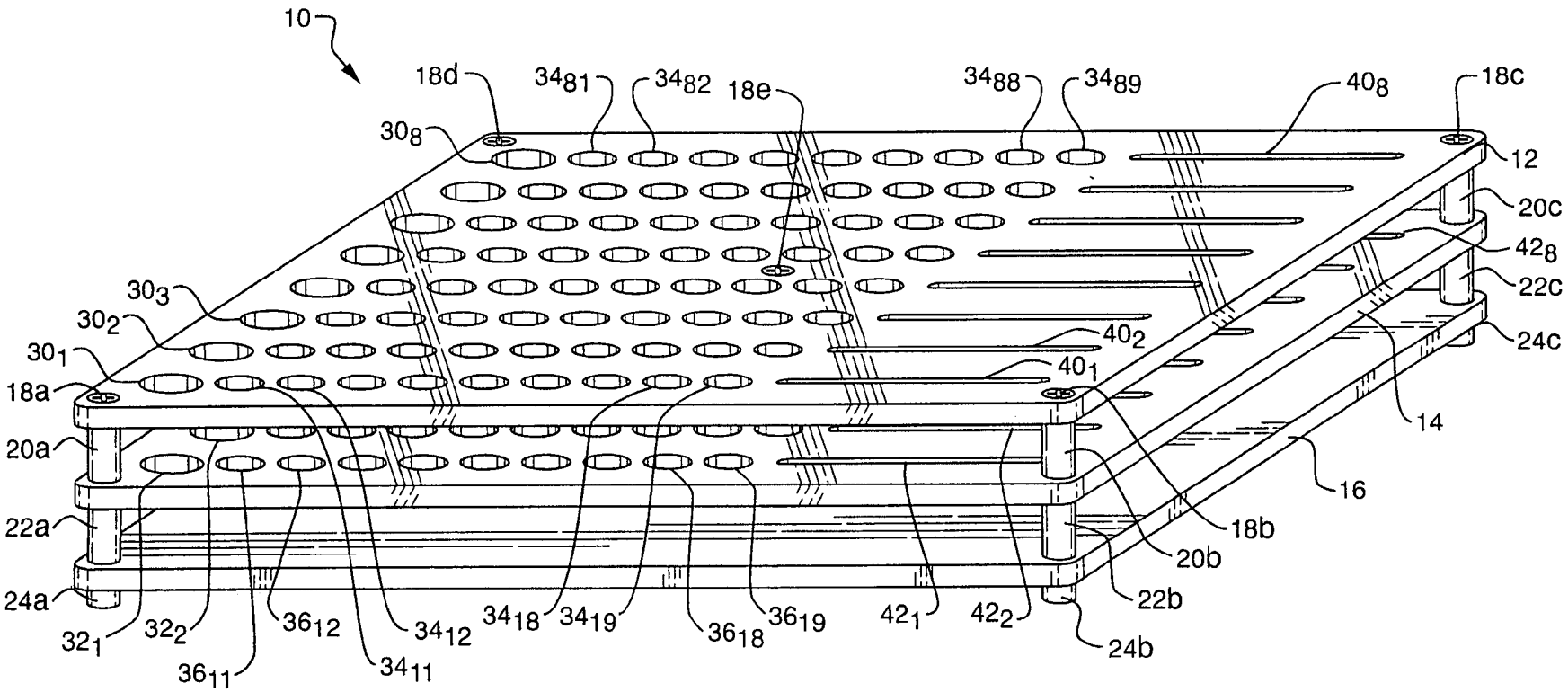
FIG. 1 is a front perspective view of an 8GC platform according to the invention.
Figure 2:
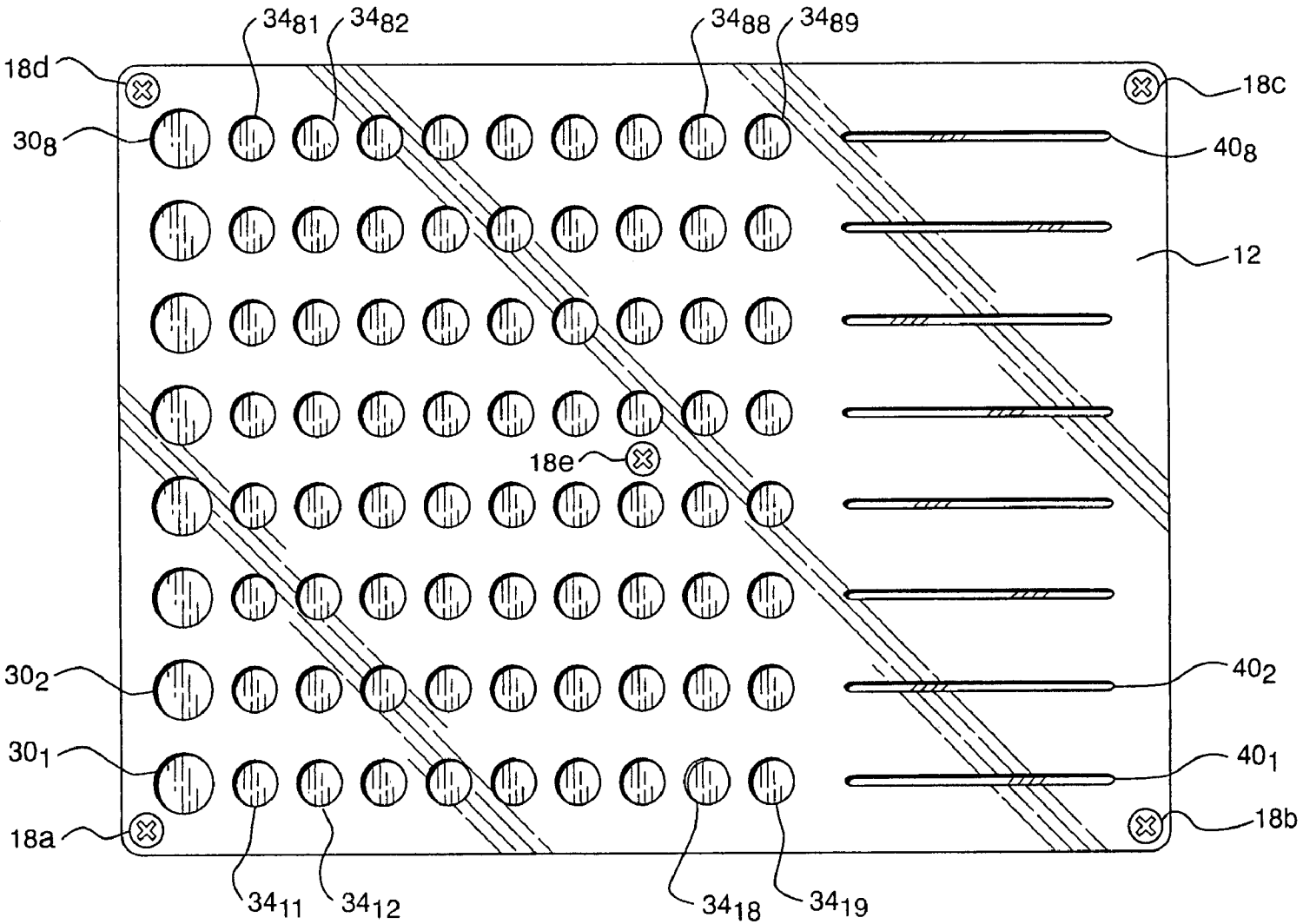
FIG. 2 is a top plan view of the 8GC platform.
Figure 3:
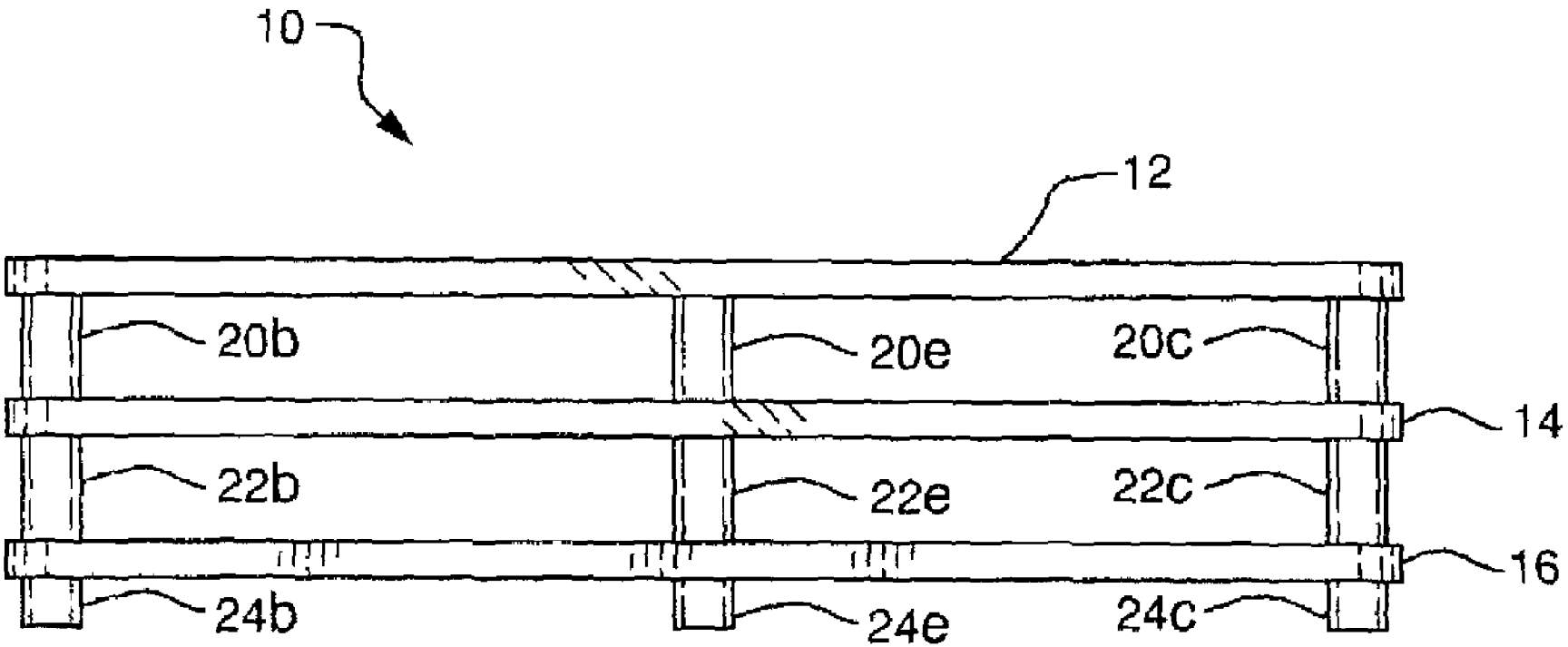
FIG. 3 is a right side elevational view of the 8GC platform.

Referring to FIG. 1, FIG. 2 and FIG. 3, FIG. 1 is a perspective view of an eight specimen gel-card (8GC) platform or workstation 10 according to the present invention, which is used for blood bank testing. FIG. 2 is a top plan view of the platform 10, and FIG. 3 is a right side elevational view of the 8GC platform 10. The testing platform 10 comprises a top plate 12, a middle plate 14 and a bottom plate 16 in separate horizontal planes parallel to each other. A first set of spacers 20*a*–20*e* are positioned around screws 18*a*–18*e* between the top plate 12 and the middle plate 14, and a second set of spacers are positioned around screws 18*a*–18*e* between the middle plate 14 and the bottom plate 16. Shorter spacers or standoffs 24*a*–24*e* are screwed on the ends of screws 18*a*–18*e* on the bottom side of the bottom plate 16. The standoff 24*e* may be made slightly shorter than standoffs 24*a*–24*d* to prevent rocking of the platform 10 while on a flat surface during use.

In the top plate 12 of the illustrative embodiment a column of eight holes $\mathbf{30}_1$–$\mathbf{30}_8$ are provided each 16 mm in diameter, and a matrix of 72 smaller holes $\mathbf{34}_{11}$–$\mathbf{34}_{89}$ are provided 12.5 mm in diameter. This matrix of small holes $\mathbf{34}_{11}$–$\mathbf{34}_{89}$ comprises 9 holes in each row and 8 holes in each column. Likewise, in the middle plate 12 the eight holes $\mathbf{32}_1$–$\mathbf{32}_8$ are 16 mm in diameter suitable for receiving blood specimen tubes, and the seventy-two smaller holes $\mathbf{36}_{11}$–$\mathbf{36}_{89}$ are 12.5 mm in diameter, suitable for receiving standard test tubes.

Still referring to FIG. 1 and FIG. 2, the top plate 12 and the middle plate 14 each comprise 80 holes and each hole in the top plate 12 is axially aligned directly above a correspondingly positioned hole in the middle plate 14. For example, hole $\mathbf{30}_1$ in a first row of the top plate 12 is directly above hole $\mathbf{32}_1$ in the middle plate. Likewise, in the same first row smaller holes $\mathbf{34}_{11}$–$\mathbf{34}_{19}$ in the top plate are directly above corresponding holes $\mathbf{36}_{11}$–$\mathbf{36}_{19}$ in the middle plate 14.

In addition to the 80 holes in the top plate 12 and 80 holes in the middle plate 14, a column of eight slots $\mathbf{40}_1$–$\mathbf{40}_8$ is provided in the top plate 12, and a column of corresponding slots $\mathbf{42}_1$–$\mathbf{42}_8$ is provided in the middle plate 14, the slots $\mathbf{40}_1$–$\mathbf{40}_8$ in the top plate 12 being aligned directly above corresponding slots $\mathbf{42}_1$–$\mathbf{42}_8$ in the middle plate 14. The slots $\mathbf{40}_1$–$\mathbf{40}_8$ in the top plate 12 of the illustrated embodiment measure 2 mm×72 mm, extend completely through the middle plate 14, and are suitably sized for receiving a standard gel-card. The slots $\mathbf{42}_1$–$\mathbf{42}_8$ in the middle plate 14 are not cut completely through the middle plate 14 and measure 2 mm×72 mm with a depth of approximately 3 mm. This enables a gel-card inserted in one of the slots $\mathbf{40}_1$–$\mathbf{40}_8$ to extend above the top plate 12 sufficiently to allow information on the gel-card to be easily read. Each row of holes in platform 10 such as the row in the top plate 12 with holes $\mathbf{30}_1$ and $\mathbf{34}_{11}$–$\mathbf{34}_{19}$ comprises slot $\mathbf{40}_1$, and likewise each row of holes in the middle plate 14 such as the row with holes $\mathbf{32}_1$ and $\mathbf{36}_{11}$–$\mathbf{36}_{19}$ comprises the partial slot $\mathbf{42}_1$.

The work station or testing station 10 is designed structurally to avoid making errors in a hospital blood bank, to simplify and speed-up the workflow process, and to better organize the workflow and conserve bench space. It allows a laboratory technologist to organize in a safe and efficient manner all the necessary testing tubes including a patient specimen tube in a single row along with a gel-card, which makes the testing visually and physically easier to perform. Having the slots $\mathbf{40}_1$–$\mathbf{40}_8$ and slots $\mathbf{42}_1$–$\mathbf{42}_8$ for receiving gel-cards on the testing platform 10 eliminates the need for another secondary workstation making it easier for a technologist to see and load the gel-card and avoid an error of planting a patient blood specimen in the wrong gel-card.

Referring again to FIG. 1, the top plate 12 and the middle plate 14 are made of plastic and may be embodied by a Lexan® polycarbonate, manufactured by General Electric Company, or by a Hyzod® polycarbonate manufactured by Sheffield Plastics, Inc. The bottom plate 16 may be embodied by a plastic made of a high density polyethylene.

Figure 4:
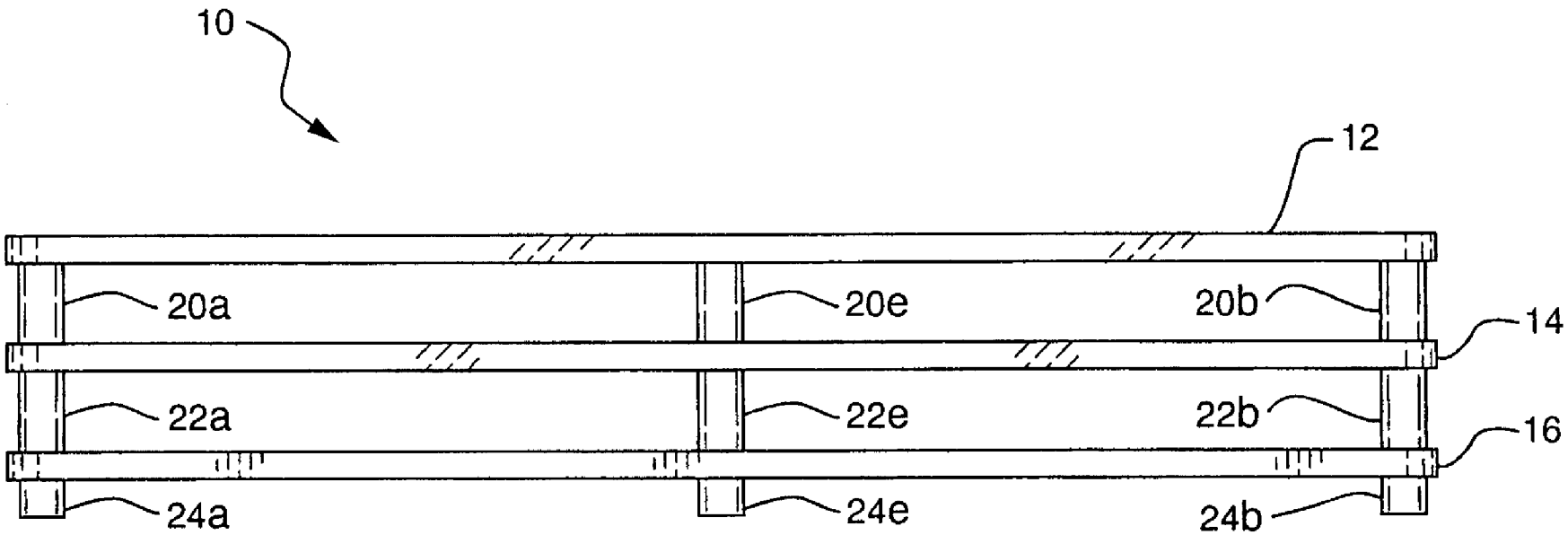
FIG. 4 is a front elevational view of the 8GC platform.

Referring to FIG. 2 and FIG. 4, FIG. 4 is a front elevational view of the testing platform 10 showing the front left corner spacers 20*a*, 22*a*, the front right corner spacers 20*b*, 22*b*, and center spacers 20*e*, 22*e*. The center spacers 20*e*, 22*e* are located approximately in the center of the platform 10. The screws 18*a*–18*d* at the corners of the platform 10 and the center screw 18*e* may be embodied by commonly available stainless steel, flat head, Phillips machine screws having a 10–32 thread and a length of 2.5 inches. The spacers 20*a*–20*e*, 22*a*–22*e* at the four corners and the center of the platform 10 may be embodied by commonly available Nylon unthreaded round spacers having a ⅜ inch O.D., ¾ inch length #10 screw size.

Figure 5:
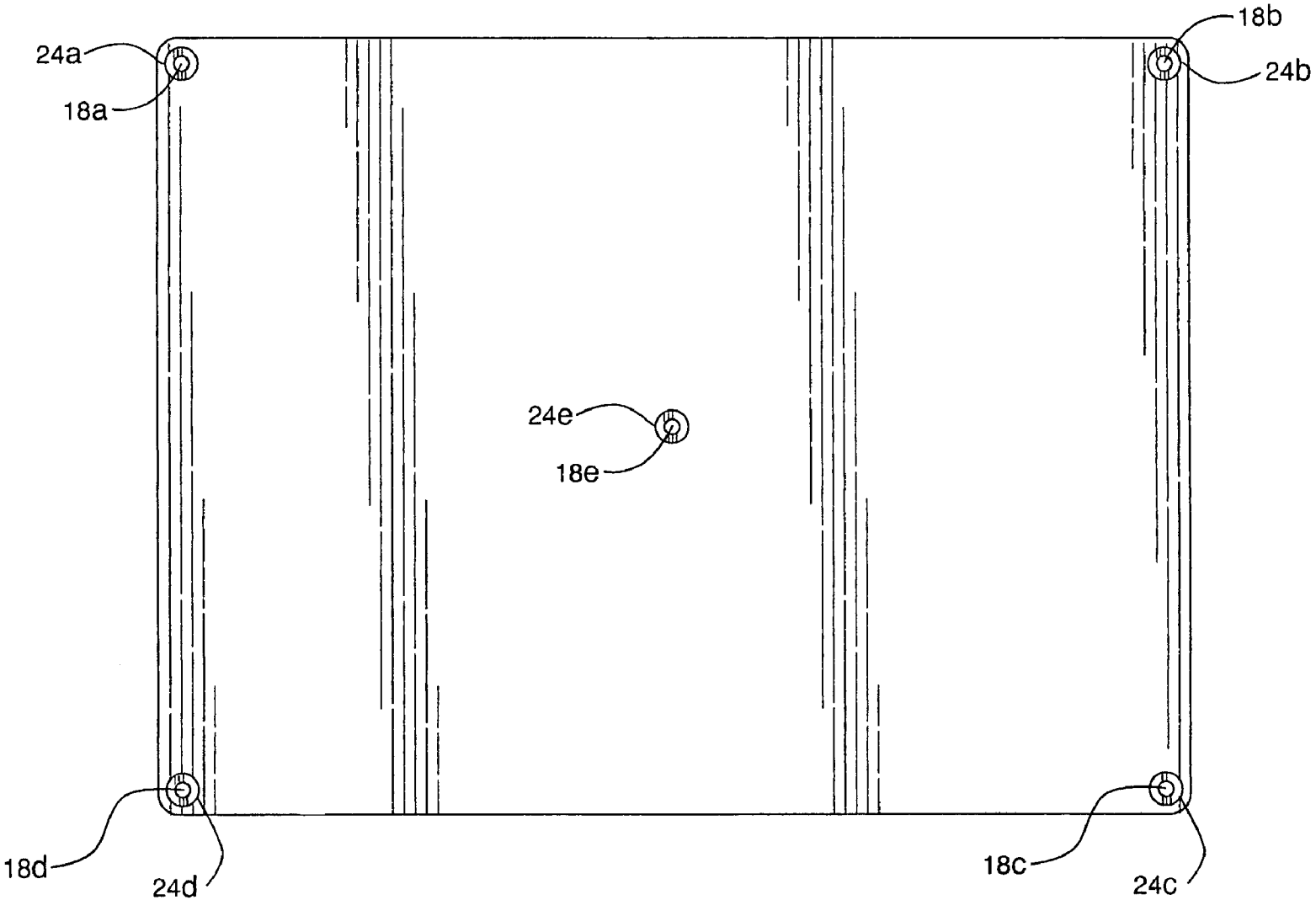
FIG. 5 is a bottom plan view of the 8GC platform.

Referring to FIG. 1 and FIG. 5, FIG. 5 shows a bottom plan view of the testing platform 10 comprising the bottom plate 16 and standoffs 24*a*–24*e*. The standoffs 24*a*–24*e* are threaded and screwed onto the end of the 10–32 screws 18*a*–18*e*. The standoffs 24*a*–24*e* are commonly available nylon threaded, round standoffs having a ⅜ inch O.D., ⅜ inch length and 10–32 thread.

The 8GC platform 10 as shown in FIG. 1 measures 11.25 inches×8.5 inches×2.5 inches and is intended to accommodate eight (8) patient specimens which are received by top plate holes $\mathbf{30}_1$–$\mathbf{30}_8$ and bottom plate holes $\mathbf{32}_1$–$\mathbf{32}_8$. However, one of ordinary skill in the art will recognize that the number of specimen holes $\mathbf{30}_1$–$\mathbf{30}_8$ along with the adjacent test tube holes and slot in each row may be increased or decreased varying the overall dimensions of the platform 10 depending on a user laboratory requirement or preference.

This invention has been disclosed in terms of a certain embodiment. It will be apparent that many modifications can be made to the disclosed apparatus without departing from the invention. Therefore, it is the intent of the appended claims to cover all such variations and modifications as come within the true spirit and scope of this invention.

What is claimed is:

1. A blood bank testing platform comprising:

a top plate spaced above a middle plate and said middle plate spaced above a bottom;

each of said top plate and said middle plate comprises a matrix of holes, said matrix of holes in said top plate being aligned with said matrix of holes in said middle plate;

a column of slots in said top plate positioned adjacent to and spaced apart from said matrix of holes in said top plate; and a column of slots in said middle plate positioned adjacent to and spaced apart from said matrix of holes in said middle plate and directly under said column of slots in said top plate, said middle plate column of slots comprises non-through slots.

2. The blood bank testing platform as recited in claim 1 wherein said platform comprises a plurality of rows, each row comprises a first type hole of said matrix of holes having a first diameter, a plurality of a second type holes of said matrix of holes having a second diameter, said second diameter being different than said first diameter, and one slot of said column of slots.

3. The blood bank testing platform as recited in claim 1 wherein said column of slots in said top plate comprises a through slot.

4. The blood bank testing platform as recited in claim 1 wherein said platform comprises corner screws for securing said top plate, said middle plate and said bottom plate together, said screws being inserted in spacers between said top plate and said middle plate and spacers between said middle plate and said bottom plate.

5. The blood bank testing platform as recited in claim 4 wherein said corner screws are screwed into standoffs on the bottom of said bottom plate.

* * * * *